US008175473B2

(12) United States Patent
Hagiwara

(10) Patent No.: US 8,175,473 B2
(45) Date of Patent: May 8, 2012

(54) CHARGING DEVICE AND IMAGE FORMING APPARATUS

(75) Inventor: Takuro Hagiwara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 372 days.

(21) Appl. No.: 12/549,467

(22) Filed: Aug. 28, 2009

(65) Prior Publication Data

US 2010/0247122 A1 Sep. 30, 2010

(30) Foreign Application Priority Data

Mar. 25, 2009 (JP) ..... 2009-075212

(51) Int. Cl.
*G03G 15/00* (2006.01)

(52) U.S. Cl. ..... 399/44; 399/50

(58) Field of Classification Search ..... 399/44, 399/50, 31, 174, 176
See application file for complete search history.

(56) References Cited

U.S. PATENT DOCUMENTS 5,786,091 A * 7/1998 Kurokawa et al. ..... 428/421
7,027,747 B2 4/2006 Iwasaki et al.
2003/0215253 A1* 11/2003 Okano et al. ..... 399/50
2005/0196193 A1* 9/2005 Tamoto et al. ..... 399/111
2009/0028591 A1* 1/2009 Kubo ..... 399/50

FOREIGN PATENT DOCUMENTS

| | | |
|---|---|---|
| JP | 2004-062062 | 2/2004 |
| JP | 2004-333789 | 11/2004 |
| JP | 2006-267739 | 10/2006 |
| JP | 2007-108493 | 4/2007 |
| JP | 2007-193107 | 8/2007 |

* cited by examiner

*Primary Examiner* — Quana M Grainger
(74) *Attorney, Agent, or Firm* — Fildes & Outland, P.C.

(57) ABSTRACT

A charging device includes: a charging member; a charging power source that applies a charging voltage to the charging member; a temperature dependence storage unit that stores preset temperature dependence; a humidity dependence storage unit that stores preset humidity dependence; an ambient temperature detecting unit that detects an ambient temperature in the vicinity of the charging member; an ambient humidity detecting unit that detects an ambient humidity in the vicinity of the charging member; and a charging voltage control unit that applies the charging voltage to the charging member according to (i) a constant current value that is determined according to the temperature dependence as corresponding to the detected ambient temperature or (ii) a constant current value that is determined according to the humidity dependence as corresponding to the detected ambient temperature and the detected ambient humidity.

7 Claims, 11 Drawing Sheets

FIG. 4

TEMPERATURE-DEPENDENT CORRECTION TABLE (TA1)

| AMBIENT TEMPERATURE Te (°C) | TEMPERATURE MARGIN Mt (%) |
|---|---|
| 30°C ≤ Te | 11 |
| 22°C ≤ Te < 30°C | 8 |
| 20°C ≤ Te < 22°C | 8 |
| 18°C ≤ Te < 20°C | 7 |
| 16°C ≤ Te < 18°C | 15 |
| 14°C ≤ Te < 16°C | 15 |
| 12°C ≤ Te < 14°C | 17 |
| 10°C ≤ Te < 12°C | 20 |
| Te < 10°C | 22 |

FIG. 5

HUMIDITY-DEPENDENT CORRECTION TABLE (TA2)

| AMBIENT HUMIDITY Hu (%RH) | MARGIN CORRECTION VALUE Mh1 (%) |
|---|---|
| 80%RH ≤ Hu | 11 |
| 70%RH ≤ Hu < 80%RH | 10 |
| 60%RH ≤ Hu < 70%RH | 9 |
| 50%RH ≤ Hu < 60%RH | 7 |
| 40%RH ≤ Hu < 50%RH | 7 |
| 30%RH ≤ Hu < 40%RH | 6 |
| 20%RH ≤ Hu < 30%RH | 6 |
| Hu < 20%RH | 6 |

CHARGING DEVICE AND IMAGE FORMING APPARATUS

CROSS-REFERENCE TO RELATED APPLICATION

This application is based on and claims priority under 35 USC 119 from Japanese Patent Application No. 2009-075212 filed Mar. 25, 2009.

BACKGROUND

Technical Field

The present invention relates to a charging device and an image forming apparatus.

SUMMARY

According to an aspect of the invention, there is provided a charging device, including:

a charging member disposed to be opposed to a body to be charged, the charging member including:

a conductor shaft;

a charging member main body that coats an outer circumferential surface of the conductor shaft; and a surface layer that coats a surface of the charging member main body and contains dispersed fine particles, the surface layer having a surface with asperities due to the dispersed fine particles;

a charging power source that applies a charging voltage to the charging member, the charging voltage being produced by superimposing a constant-current-controlled AC voltage on a preset DC voltage;

a temperature dependence storage unit that stores preset temperature dependence representing a relationship between a constant current value at the time the AC voltage is constant-current-controlled and an ambient temperature which is a temperature in a vicinity of the charging member;

a humidity dependence storage unit that stores preset humidity dependence representing a relationship between the constant current value and the ambient temperature and an ambient humidity which is a humidity in the vicinity of the charging member;

an ambient temperature detecting unit that detects an ambient temperature in the vicinity of the charging member;

an ambient humidity detecting unit that detects an ambient humidity in the vicinity of the charging member; and a charging voltage control unit that applies the charging voltage to the charging member according to (i) a constant current value that is determined according to the temperature dependence as corresponding to the detected ambient temperature or (ii) a constant current value that is determined according to the humidity dependence as corresponding to the detected ambient temperature and the detected ambient humidity.

BRIEF DESCRIPTION OF THE DRAWINGS

Exemplary embodiments of the present invention will be described in detail based on the following figures, wherein:

FIG. 4 shows a temperature-dependent correction table which is stored in a temperature dependence storage unit according to the first exemplary embodiment of the invention;

FIG. 5 shows a humidity-dependent correction table which is stored in a humidity dependence storage unit according to the first exemplary embodiment of the invention;

DETAILED DESCRIPTION

Figure 1:
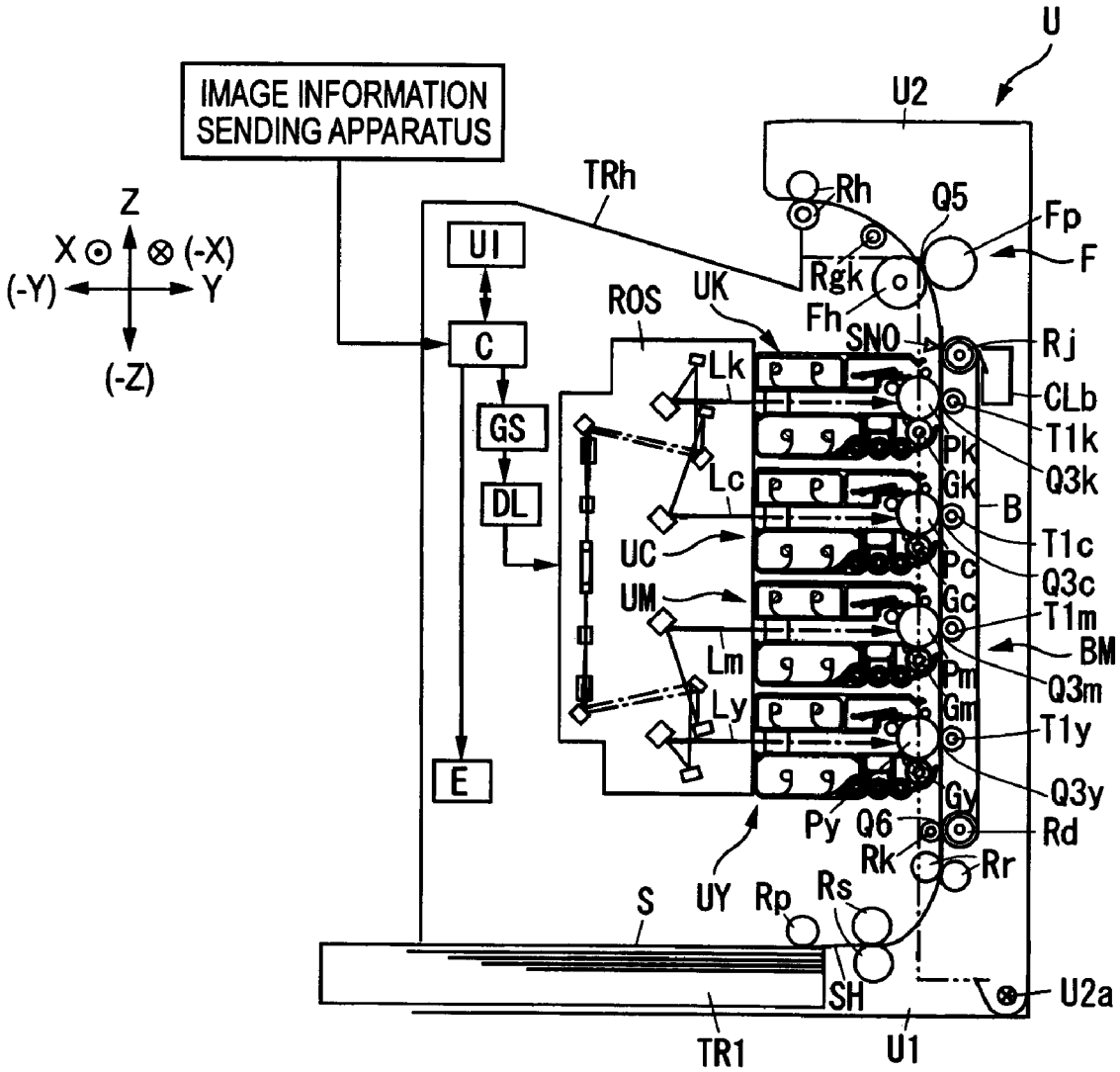
FIG. 1 illustrates the whole of an image forming apparatus according to a first exemplary embodiment of the present invention.

Exemplary embodiments of the present invention will be hereinafter described with reference to the drawings. However, the invention is not limited to the following exemplary embodiments.

To facilitate understanding of the following description, in the drawings, the X-axis direction, the Y-axis direction, and the Z-axis direction are defined as the front-rear direction, the right-left direction, and the top-bottom direction, respectively and the directions or sides indicated by arrows X, −X, Y, −Y, and Z, and −Z are defined as the front direction or side, the rear direction or side, the right direction or side, the left direction or side, the top direction or side, and the bottom direction or side, respectively.

In the drawings, a circle "○" having a dot "•" inside means an arrow that is directed from the back side to the front side of the paper surface and a circle "○" having a cross "×" inside means an arrow that is directed from the front side to the back side of the paper surface.

Furthermore, in the drawings, to facilitate understanding, members etc. that are not indispensable for the description may be omitted as appropriate.

[First Exemplary Embodiment]

FIG. 1 illustrates the whole of a printer U which is an example image forming apparatus according to a first exemplary embodiment of the invention.

As shown in FIG. 1, a sheet tray TR1 for housing recording sheets S which are example media on which images are to be recorded occupies a bottom portion of the printer U and the top surface of the printer U is formed with an ejected medium tray TRh which is an example medium stacking unit. A user interface UI as an example operation instruction input unit through which an operator inputs an instruction is provided as a top portion of the printer U.

As shown in FIG. 1, the printer U according to the first exemplary embodiment has an image forming apparatus main body U1 and an openable/closeable unit U2 which can be opened and closed being rotated about a rotation center U2*a* which is provided in the image forming apparatus main body U1 at a bottom-right position. To enable replacement of process cartridges (described later) and removal of a jammed recording medium S, the openable/closeable unit U2 can be moved between an open position (not shown) for exposing the inside of the image forming apparatus main body U1 and an ordinary position shown in FIG. 1 where it is located when an image forming operation is performed.

The printer U is equipped with a control section C for performing various controls of the printer U, an image processing section GS whose operation is controlled by the control section C, an image writing device drive circuit DL, a power circuit E, etc. The power circuit E applies voltages to charging rolls CRy-CRk which are example charging members, developing rolls G1*y*-G1*k* which are example developer holding bodies, and transfer rolls T1*y*-T1*k* which are example transfer devices (described later).

The image processing section GS converts print information that is supplied from an external image information sending apparatus or the like into pieces of latent image forming image information corresponding to images of four colors (K (black), Y (yellow), M (magenta), and C (cyan)) and outputs them to the image writing device drive circuit DL with prescribed timing. The image writing device drive circuit DL outputs drive signals corresponding to the received pieces of image information of the respective colors to a latent image writing device ROS which is an example latent image forming device. The latent image writing device ROS emits laser beams Ly, Lm, Lc, and Lk which are example image writing light beams of the respective colors according to the received drive signals.

As shown in FIG. 1, visible image forming devices UY, UM, UC, and UK which are example image recording units for forming toner images which are example visible images of the respective colors (Y (yellow), M (magenta), and C (cyan), K (black)) are disposed on the right of the latent image writing device ROS.

Figure 2:
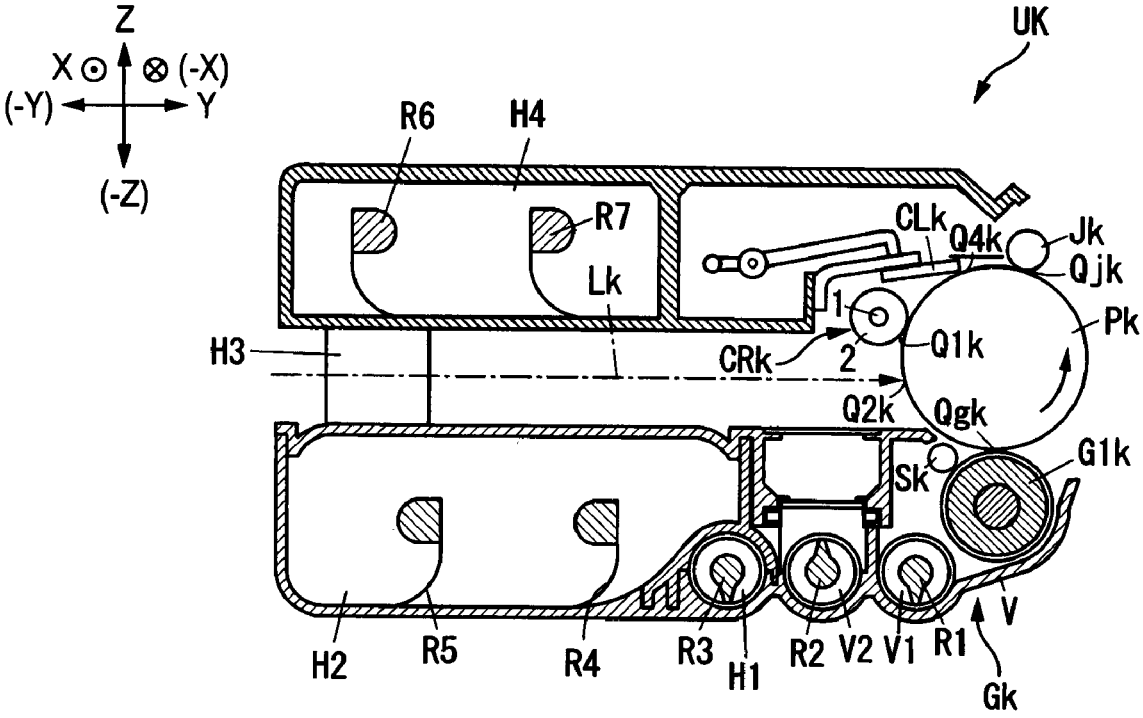
FIG. 2 illustrates a visible image forming device which is an example detachable unit according to the first exemplary embodiment of the invention.

FIG. 2 illustrates the visible image forming device Uk of K (black) which is an example detachable unit according to the first exemplary embodiment of the invention.

As shown in FIG. 2, the visible image forming device Uk is equipped with a rotary body to be charged and a photoreceptor Pk which is an example image carrier. A charging roll CRk, a developing device Gk for developing an electrostatic latent image on the surface of the photoreceptor Pk into a visible image, a charge removing member Jk for removing charge from the surface of the photoreceptor Pk, a photoreceptor cleaner CLk which is an example image carrier cleaner for removing developer remaining on the surface of the photoreceptor Pk, and other members are disposed around the photoreceptor Pk.

The developing device Gk is equipped with a development container V which contains a developer and a developing roll G1*k* as an example developer holding body which rotates while holding developer which is part of the developer contained in the development container V. A layer thickness limiting member Sk for limiting the layer thickness of developer on the surface of the developing roll G1*k* is provided in the development container V so as to be opposed to the developing roll G1*k*. The development container V has agitation transport rooms V1 and V2 for agitating and transporting developer to be supplied to the developing roll G1*k*, and circulation transport members R1 and R2 for circulating and transporting developer are provided in the respective agitation transport rooms V1 and V2. A developer supply passage H1 is connected to the left-hand agitation transport room V2, and a first developer supply room H2 which contains a supply developer is connected to the developer supply passage H1.

The first developer supply room H2 is connected, via a developer supply connection passage H3, to a second developer supply room H4 which is located above. Supply developer transport members R3, R4 and R5, and F6 and R7 for transporting developer toward the agitation transport rooms V1 and V2 are provided in the developer supply passage H1, the first developer supply room H2, and the second developer supply room H4. The members H1-H4 and R3-R7 constitute a developer supply container (H1-H4+R3-R7) according to the first exemplary embodiment.

After the surface of the photoreceptor Pk is charged uniformly by the charging roll CRk at a charging region Q1*k* which is opposed to the charging roll CRk, a latent image is written to the surface of the photoreceptor Pk by a laser beam Lk at a latent image forming region Q2*k*. The thus-written latent image is visualized at a developing region Qgk which is opposed to the developing device Gk.

The visible image forming device UK of black according to the first exemplary embodiment is a detachable unit (what is called a process cartridge UK) in which the photoreceptor Pk, the charging roll CRk, the developing device Gk, the charge removing member Jk, the photoreceptor cleaner CLk, the developer supply container (H1-H4+R3-R7), etc. are integrated together in a detachable manner. The visible image forming device UK can be detached from the image forming apparatus main body U1 in a state that the openable/closeable unit U2 has been moved to the open position.

Like the visible image forming device UK of black, the visible image forming devices UY, UM, and UC of the other colors are detachable units (what is called process cartridges UY, UM, and UC) which can be detached from the image forming apparatus main body U1. In the printer U according to the first exemplary embodiment, the process cartridges UY-UK are arranged in the top-bottom direction.

As shown in FIG. 1, a belt module BM which is an example band-like member driving device is disposed on the right of the photoreceptor bodies Py-Pk. The belt module BM has an endless medium conveying belt B as an example band-like member which is opposed to the process cartridges UY-UK. The medium conveying belt B is rotatably supported by a belt support roll group (Rd+Rj) which is an example stretching member group. The belt support roll group (Rd+Rj) has a belt drive roll Rd which is an example upstream stretching member as well as an example drive member disposed on the upstream side in the medium conveying direction (at the bottom), a follower roll Rj which is an example downstream stretching member as well as an example follower member disposed on the downstream side in the medium conveying direction (at the top), and transfer rolls T1*y*, T1*m*, T1*c*, and T1*k* which are opposed to the respective photoreceptor bodies Py-Py with the medium conveying belt B interposed in between.

An image density sensor SNO which an example image density detecting device for detecting, with prescribed timing, a density of a density detection image (what is called a patch image) formed by an image density adjusting unit (not shown) of the control section C is disposed on the downstream side in the medium conveying direction of the medium conveying belt B (at a top position). The image density adjusting unit of the control section C adjusts the voltages to be applied to the charging roller CRy-CRk, the developing devices Gy-Gk, and the transfer rolls T1*y*-T1*k* and the intensities of latent image writing light beams Ly-Lk on the basis of the image density detected by the image density sensor SNO, and thereby adjusts or corrects the image density (i.e., performs what is called a process control).

A belt cleaner CLb which is an example conveying member cleaner is disposed downstream of the image density sensor SNO in the medium conveying direction of the medium conveying belt B. A medium absorbing roll Rk which is an example recording medium absorbing member for absorbing a recording medium S on the medium conveying belt B is disposed at such a position as to be opposed to the drive roll Rd with the medium conveying belt B interposed in between.

Recording media S in the sheet tray TR1 which is disposed below the medium conveying belt B are picked up by a pickup roll Rp which is an example medium pickup member, separated into individual media by separating rolls Rs which are example medium separating members, and conveyed to a recording medium conveying path SH.

Each recording medium S is sent along the recording medium conveying path SH to registration rolls Rr which are example paying-out members for adjusting the timing of supply of the recording medium S to the medium conveying belt B. The registration rolls Rr pay out the recording medium S with prescribed timing to a recording medium absorbing position Q6 which is a region where the drive roll Rd and the medium absorbing roll Rk are opposed to each other. The recording medium S that has been conveyed to the recording medium absorbing position Q6 is absorbed electrostatically on the medium conveying belt B.

The recording medium S absorbed on the medium conveying belt B passes transfer regions Q3*y*, Q3*m*, Q3*c*, and Q3*k* sequentially, where the recording medium S is brought into contact with the respective photoreceptor bodies Py-Pk.

At each of the transfer regions Q3*y*, Q3*m*, Q3*c*, and Q3*k*, a transfer voltage whose polarity is opposite to a toner charging polarity is applied to the corresponding one of the transfer rolls T1*y*, T1*m*, T1*c*, and T1*k* (disposed on the back side of the medium conveying belt B) with prescribed timing from the power circuit E which is controlled by the control section C.

In the case of forming a multicolor image, toner images on the respective photoreceptor bodies Py-Pk are transferred to the recording medium S on the medium conveying belt B so as to be superimposed one on another by the transfer rolls T1*y*, T1*m*, T1*c*, and T1*k*. In the case of forming a monochrome image, only K (black) toner image is formed on the photoreceptor Pk and transferred to the recording medium S by the transfer roll T1*k*.

After the toner image transfer, charge is removed from the photoreceptor bodies Py-Pk by the charge removing members Jy-Jk at charge removing regions Qjy-Qjk, respectively. Then, toner remaining on the surfaces of the photoreceptor bodies Py-Pk is removed by the photoreceptor cleaners CLy-CLk at cleaning regions Q4*y*-Q4*k*, respectively. Then, the photoreceptor bodies Py-Pk are charged again by the respective charging rolls CRy-CRk.

The toner images formed on the recording medium S are fused at a fixing region Q5 where a heating roll Fh (an example heat fixing member) and a pressing roll Fp (an example pressure fixing member) of a fixing device F are pressed against each other. The recording medium S bearing a fused image is ejected to the ejected medium tray TRh from sheet ejecting rolls Rh which are example sheet ejecting members while being guided by a guide roller Rgk which is an example ejection guiding member.

After separation of the recording medium S, the medium conveying belt B is cleaned by the belt cleaner CLb.

(Charger)

As shown in FIG. 2, the charging roll CRk has a conductor shaft 1 which is an example rotary shaft made of a conductive material and extending in the front-rear direction, and a charging roll main body 2 which is an example charging member main body is supported by the circumferential surface of the conductor shaft 1. The charging roll main body 2 according to the first exemplary embodiment has an elastic layer made of an elastic rubber containing conductive particles such as carbon black, and the surface of the elastic layer is coated with a surface layer which is an insulative resin thin film. The surface layer of the charging roll main body 2 is such that fine particles of several micrometers in diameter are dispersed in a resin thin film of several micrometers in thickness, whereby the surface of the charging roll main body 2 is formed with minute asperities. A 9-μm-thick nylon resin can be used as the resin thin film of the surface layer of the charging roll main body 2 and nylon resins of about 5 μm in diameter (the same as toner particles in diameter) can be used as the fine particles to be dispersed in the resin thin film of the surface layer.

(Control Section C of First Exemplary Embodiment)

Figure 3:
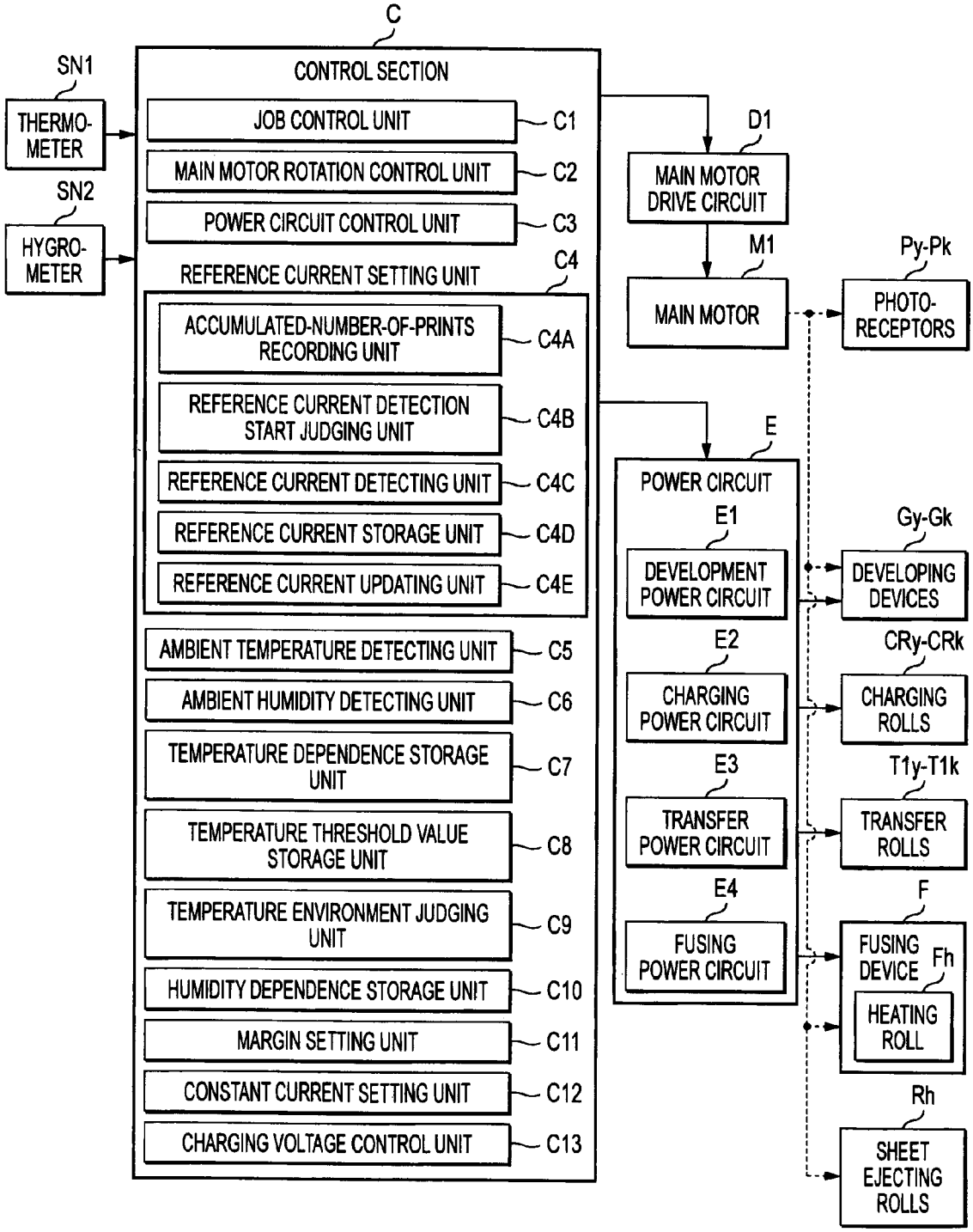
FIG. 3 is a block diagram showing functions of a control section of the image forming apparatus according to the first exemplary embodiment of the invention.

FIG. 3 is a block diagram showing functions of the control section C of the printer U according to the first exemplary embodiment of the invention.

As shown in FIG. 3, the control section C of the printer U according to the first exemplary embodiment is a microcomputer, more specifically, a computer which is composed of an input/output interface (I/O) which is an example input/output signal adjusting section for performing input/output of signals from and to the outside, adjustment of input/output signal levels, and other processing, a read-only memory (ROM) and a hard disk drive (HDD) which are example auxiliary storage devices stored with programs for execution of necessary processes, related data, etc., a random access memory (RAM) which stores necessary data temporarily, a central processing unit (CPU) which executes a process according to a program stored in the ROM or the HDD, a clock generator, etc. Various functions can be realized by running the programs stored in the ROM.

(Signal Input Elements Connected to Control Section C)

Output signals of the following signal input elements are input to the control section C.

Thermometer SN1: A thermometer SN1 which is an example ambient temperature detecting unit detects an ambient temperature Te of the printer U and inputs the resulting detection signal to the control section C.

Hygrometer SN2: A hygrometer SN2 which is an example ambient humidity detecting unit detects ambient humidity Hu of the printer U and inputs the resulting detection signal to the control section C.

(Control Subject Elements Connected to Control Section C)

The control section C outputs control signals for the following control subject elements D1 and E.

Main motor drive circuit D1: A main motor drive circuit D1 which is an example main drive source drive circuit drives a main motor M1 which is an example main drive source and thereby rotationally drives the photoreceptor bodies Py-Pk, the developing devices Gy-Gk, the heating roll Fh of the fixing device F, the sheet ejecting rolls Rh, etc.

Power circuit E: The power circuit E supplies power and has a development power circuit E1, a charging power circuit E2, a transfer power circuit E3, and a fixing power circuit E4.

Development power circuit E1: The development power circuit E1 applies development voltages to the developing devices Gy-Gk.

Charging power circuit E2: The charging power circuit E2 which is an example charging power source applies charging voltages to the charging rolls CRy-CRk.

Transfer power circuit E3: The transfer power circuit E3 applies transfer voltages to the transfer rolls T1*y*-T1*k*.

Fixing power circuit E4: The fixing power circuit E4 supplies heating power to a heater as an example heating member of the heating roll Fh of the fixing device F.

(Functions of Control Section C)

The control section C functions as the following function implementing unit by running programs for control of operations of the following control subject elements according to output signals of the above signal input elements.

Job control unit C1: A job control unit C1 which is an example image forming operation control unit carries out a job which is an example image forming operation by controlling the operations of the charging rolls CRy-CRk, the transfer rolls T1*y*-T1*k*, the fixing device F, etc. according to image information that is sent from the image information sending apparatus or the like.

Main motor rotation control unit C2: A main motor rotation control unit C2 which is an example main drive source rotation control unit controls driving of the photoreceptor bodies Py-Pk, the developing devices Gy-Gk, the heating roll Fh of the fixing device F, the sheet ejecting rolls Rh, etc. by controlling the rotation of the main motor M1 via the main motor drive circuit D1.

Power circuit control unit C3: A power circuit control unit C3 controls the supply of voltages and currents for controlling the developing devices Gy-Gk, the charging rolls CRy-CRk, the transfer rolls T1*y*-T1*k*, the heater of the heating roll Fh of the fixing device F, etc. by controlling the operation of the power circuit E.

Reference current setting unit C4: A reference current setting unit C4 has an accumulated-number-of-prints recording unit C4A, a reference current detection start judging unit C4B, a reference current detecting unit C4C, a reference current storage unit C4D, and a reference current updating unit C4E. The reference current setting unit C4 according to the first exemplary embodiment sets a reference current value $I_k$ as a reference of a constant current value $I_{ac}$ for constant-current-controlled AC voltages to be applied to the charging rolls CRy-CRk.

Accumulated-number-of-prints recording unit C4A: The accumulated-number-of-prints recording unit C4A stores an accumulated number n of prints (recording media S) produced by the printer U.

Reference current detection start judging unit C4B: The reference current detection start judging unit C4B judges whether to start detection of a reference current value $I_k$. The reference current detection start judging unit C4B according to the first exemplary embodiment judges whether to start detection of a reference current value $I_k$ by judging whether the accumulated number n of prints has exceeded a preset start judgment number na, which is 100, for example.

Reference current detecting unit C4C: The reference current detecting unit C4C detects a reference current value $I_k$. The reference current detecting unit C4C according to the first exemplary embodiment detects a reference current value $I_k$ for constant-current-controlled AC voltages applied to the charging rolls CRy-CRk when the reference current detection start judging unit C4B has judged that detection of a reference current value $I_k$ should be started. More specifically, the reference current detecting unit C4C gradually increases the AC voltages applied to the charging rolls CRy-CRk while measuring the surface potentials of the photoreceptor bodies Py-Pk with surface potentiometers (not shown), detects AC voltages in a state that the surface potentials of the photoreceptor bodies Py-Pk have stopped increasing and become constant (saturated), and detects a reference current value $I_k$ on the basis of the detected AC voltages. The technique for detecting a reference current value $I_k$ for the charging rolls CRy-CRk will not be described in detail because it is known, that is, it is disclosed in JP-A-2004-333789, JP-A-2007-52125, JP-A-2007-187933, etc.

Reference current storage unit C4D: The reference current storage unit C4D stores the reference current value $I_k$. The reference current storage unit C4D according to the first exemplary embodiment stores the reference current value $I_k$ detected by the reference current detecting unit C4C.

Reference current updating unit C4E: The reference current updating unit C4E updates the reference current value $I_k$ stored in the reference current storage unit C4D when a new reference current value $I_k$ is detected by the reference current detecting unit C4C.

Ambient temperature detecting unit C5: An ambient temperature detecting unit C5 detects an ambient temperature Te. The ambient temperature detecting unit C5 according to the first exemplary embodiments detects, with the thermometer SN1, an ambient temperature Te which is a temperature in the vicinity of the charging rolls CRy-CRk of the printer U.

Ambient humidity detecting unit C6: An ambient humidity detecting unit C6 detects ambient humidity Hu. The ambient humidity detecting unit C6 detects, with the hygrometer SN2, ambient humidity Hu which is humidity in the vicinity of the charging rolls CRy-CRk of the printer U.

FIG. 4 shows a temperature-dependent correction table TA1 which is stored in a temperature dependence storage unit C7 according to the first exemplary embodiment of the invention.

Temperature dependence storage unit C7: The temperature dependence storage unit C7 stores temperature dependence which is a relationship between the constant current value $I_{ac}$ at which white points due to a charging failure disappear and the ambient temperature Te in a case that the AC voltages of the charging voltages are constant-current-controlled.

In the first exemplary embodiment, a constant current value $I_{ac}$ is determined by multiplying the reference current value $I_k$ set by the reference current setting unit C4 by a temperature margin Mt as an example temperature-dependent correction value which varies depending on the ambient temperature Te. The temperature dependence storage unit C7 according to the first exemplary embodiment stores, as the temperature dependence, a temperature-dependent correction table TA1, which is an example temperature-dependent correction table, which correlates the temperature margin Mt with the ambient temperature Te.

In the temperature-dependent correction table TA1 according to the first exemplary embodiment shown in FIG. 4, the temperature margin Mt in percentage which is correlated with the detected ambient temperature Te is a value to be added to the reference current value $I_k$ (100%).

The temperature margin Mt is 22%, 20%, 17%, 15%, 15%, 7%, 8%, 8%, and 11% when the ambient temperature Te is lower than 10° C., higher than or equal to 10° C. and lower than 12° C., higher than or equal to 12° C. and lower than 14° C., higher than or equal to 14° C. and lower than 16° C., higher than or equal to 16° C. and lower than 18° C., higher than or equal to 18° C. and lower than 20° C., higher than or equal to 20° C. and lower than 22° C., higher than or equal to 22° C. and lower than 30° C., and higher than or equal to 30°

C., respectively. The specific values of the temperature margin Mt which is correlated with the ambient temperature Te are not limited to the above example values and can be changed arbitrarily according to the design, specification, etc.

Temperature threshold value storage unit C8: A temperature threshold value storage unit C8 stores a temperature threshold value Ta which is an ambient temperature threshold value for a judgment as to whether a constant current value $I_{ac}$ should be calculated according to the temperature dependence, or humidity dependence which is a relationship between the constant current value $I_{ac}$ at which color points and black points disappear and the ambient temperature Te and the ambient humidity Hu. In the first exemplary embodiment, a preset temperature threshold value Ta=18° C. is stored. The specific value of the temperature threshold value Ta is not limited to this example value and can be changed arbitrarily according to the design, specification, etc.

Temperature environment judging unit C9: A temperature environment judging unit C9 judges whether the ambient temperature Te falls into a temperature environment of the preset temperature threshold value Ta or higher. The temperature environment judging unit C9 according to the first exemplary embodiment judges whether the ambient temperature Te falls into a temperature environment of the temperature threshold value Ta or higher by judging whether the ambient temperature Te is higher than or equal to the temperature threshold value Ta.

FIG. 5 shows a humidity-dependent correction table TA2 which is stored in a humidity dependence storage unit C10 according to the first exemplary embodiment of the invention.

Humidity dependence storage unit C10: The humidity dependence storage unit C10 stores humidity dependence which is a relationship between the constant current value $I_{ac}$ at which color points and black points disappear and the ambient temperature Te and the ambient humidity Hu.

In the first exemplary embodiment, a constant current value $I_{ac}$ is determined by multiplying the reference current value $I_k$ set by the reference current setting unit C4 by a humidity margin Mh which is an example humidity dependence obtained by adding a margin correction value Mh1 which is an example correction value that varies depending on the ambient humidity Hu and to the temperature margin Mt which varies depending on the ambient temperature Te (Mh=Mt+Mh1), in the case of a temperature environment of the temperature threshold value Ta or higher. The humidity dependence storage unit C10 according to the first exemplary embodiment stores a humidity-dependent correction table TA2, which is an example humidity-dependent correction table, which correlates the margin correction value Mh1 with the ambient humidity Hu instead of the humidity margin Mh which is the humidity dependence.

The humidity-dependent correction table TA2 according to the first exemplary embodiment shown in FIG. 5 shows the margin correction value Mh1 in percentage which is correlated with the detected ambient humidity Hu with the reference current value $I_k$ regarded as 100%. The margin correction value Mh1 is 6%, 6%, 6%, 7%, 7%, 9%, 10%, and 11% when the ambient humidity Hu is lower than 20% RH, higher than or equal to 20% RH and lower than 30% RH, higher than or equal to 30% RH and lower than 40% RH, higher than or equal to 40% RH and lower than 50% RH, higher than or equal to 50% RH and lower than 60% RH, higher than or equal to 60% RH and lower than 70% RH, higher than or equal to 70% RH and lower than 80% RH, and higher than 80% RH, respectively. The specific values of the humidity margin correction value Mh1 which is correlated with the ambient humidity Hu are not limited to the above example values and can be changed arbitrarily according to the design, specification, etc.

Margin setting unit C11: A margin setting unit C11 which is an example correction value setting unit sets a margin Ma as an example correction value to be used for correcting the reference current value $I_k$ which is used for determining a constant current value $I_{ac}$. If the ambient temperature Te is lower than the temperature threshold value Ta, the margin setting unit C11 according to the first exemplary embodiment sets, as a margin Ma, the temperature margin Mt corresponding to the ambient temperature Te in the temperature-dependent correction table TA1 stored in the temperature dependence storage unit C7. If the ambient temperature Te is higher than or equal to the temperature threshold value Ta, the margin setting unit C11 sets, as a margin Ma, a humidity margin Mh obtained by adding, to the temperature margin Mt corresponding to the ambient temperature Te, the margin correction value Mh1 corresponding to the ambient humidity Hu in the humidity-dependent correction table TA2.

Constant current setting unit C12: A constant current setting unit C12 sets a constant current value $I_{ac}$ by correcting the preset reference current value $I_k$ using the margin Ma set by the margin setting unit C11. The constant current setting unit C12 according to the first exemplary embodiment sets a constant current value $I_{ac}$ by multiplying the reference current value $I_k$ by the margin Ma.

Charging voltage control unit C13: By controlling the charging power circuit E2, a charging voltage control unit C13 applies, to the charging rolls CRy-CRk, charging voltages whose AC voltages are constant-current-controlled using the constant current values $I_{ac}$ set by the constant current setting unit C12.

The charging rolls CRy-CRk, the charging power circuit E2, the units C3-C13, etc. constitute a charging device (CRy-CRk+E2+C3-C13).

(Flowchart of First Exemplary Embodiment)

Next, a process executed in the printer U according to the first exemplary embodiment of the invention will be described with reference to a flowchart.

(Flowchart of Charging Voltage Control Process of First Exemplary) Embodiment

Figure 6:
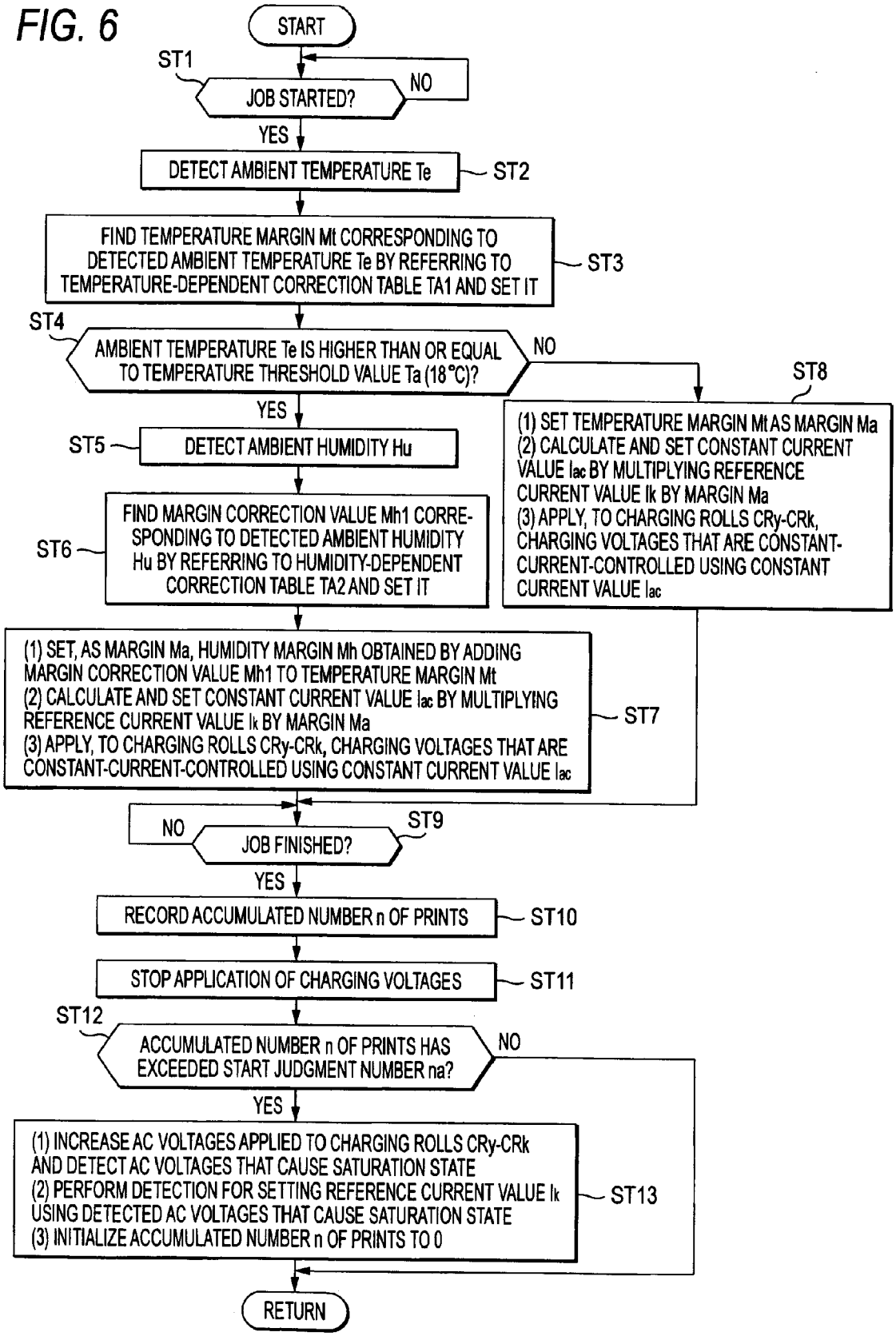
FIG. 6 is a flow chart of a charging voltage control process which is executed in the image forming apparatus according to the first exemplary embodiment of the invention.

FIG. 6 is a flowchart of a charging voltage control process which is executed in the image forming apparatus according to the first exemplary embodiment.

The steps in the flowchart of FIG. 6 are executed according to a program that is stored in the ROM or the like of the printer U. This process is executed parallel with other processes of the printer U.

The process of FIG. 6 is started when the printer U is powered on.

At step ST1 shown in FIG. 6, it is judged whether a job has been started. The process moves to step ST2 if the judgment result is affirmative, and step ST1 is executed again if the judgment result is negative.

At step ST2, an ambient temperature Te is detected, then the process moves to step ST3. At step ST3, a temperature margin Mt corresponding to the detected ambient temperature Te is found by referring to the preset temperature-dependent correction table TA1 and is set. Then, the process moves to step ST4.

At step ST4, it is judged whether the detected ambient temperature Te is higher than or equal to the preset temperature threshold value Ta (18° C.). The process moves to step ST5 if the judgment result is affirmative, and moves to step ST8 if the judgment result is negative.

At step ST5, ambient humidity Hu is detected, then the process moves to step ST6. At step ST6, a humidity margin correction value Mh1 corresponding to the detected ambient humidity Hu is found by referring to the preset humidity-dependent correction table TA2 and is set. Then, the process moves to step ST7.

At step ST7, the following pieces of processing (1)-(3) are performed (the process thereafter moves to step ST9):

(1) Set, as a margin Ma, a humidity margin Mh obtained by adding the humidity margin correction value Mh1 to the temperature margin Mt.

(2) Calculate and set a constant current value $I_{ac}$ by multiplying a preset reference current value $I_k$ by the margin Ma.

(3) Apply, to the charging rolls CRy-CRk, charging voltages that are constant-current-controlled using the constant current value $I_{ac}$.

At step ST8, the following pieces of processing (1)-(3) are performed (the process thereafter moves to step ST9):

(1) Set the temperature margin Mt as a margin Ma.

(2) Calculate and set a constant current value $I_{ac}$ by multiplying a preset reference current value $I_k$ by the margin Ma.

(3) Apply, to the charging rolls CRy-CRk, charging voltages that are constant-current-controlled using the constant current value $I_{ac}$.

At step ST9, it is judged whether the job has finished. The process moves to step ST10 if the judgment result is affirmative, and step ST9 is executed again if the judgment result is negative.

At step ST10, an accumulated number n of prints is recorded as the number of prints (recording sheets S) produced by the printer U, then the process moves to step ST11. At step ST11, the application of the charging voltages is stopped, then the process moves to step ST12.

At step ST12, it is judged whether the accumulated number n of prints has exceeded the preset start judgment number na. The process moves to step ST13 if the judgment result is affirmative, and returns to step ST1 is if the judgment result is negative.

At step ST13, the following pieces of processing (1)-(3) are performed (the process thereafter returns to step ST1):

(1) Increase the AC voltages applied to the charging rolls CRy-CRk and detect AC voltages that cause a saturation state.

(2) Perform detection for setting a reference current value $I_k$ using the detected AC voltages that cause a saturation state.

(3) Initialize the accumulated number n of prints to 0.

(Operation of First Exemplary Embodiment)

In the above-configured printer U according to the first exemplary embodiment of the invention, while a job carried out, a temperature margin Mt corresponding to an ambient temperature Te that is detected by the thermometer SN1 is found by referring to the preset temperature-dependent correction table TA1.

If the detected ambient temperature Te is lower than the temperature threshold value Ta (18° C.), a constant current value $I_{ac}$ is calculated and set by multiplying a preset reference current value $I_k$ by the temperature margin Mt.

On the other hand, if the detected ambient temperature Te is high than or equal to the temperature threshold value Ta (18° C.), a margin correction value Mh1 corresponding to ambient humidity Hu detected by the hygrometer SN2 is found by referring to the humidity-dependent correction table TA2 and a humidity margin Mh is calculated by adding the margin correction value Mh1 to the temperature margin Mt. A constant current value $I_{ac}$ is calculated and set by multiplying a preset reference current value $I_k$ by the humidity margin Mh.

In general, in image forming apparatus, image defects called white points tend to increase as the temperature goes low and image defects called color points and black points tend to increase as the temperature or the humidity goes high. In conventional charging rolls whose surfaces are smooth (i.e., the degree of asperity is low), a sufficient margin is secured automatically against color points if a margin is set so as to prevent white points. Image detects are prevented by controlling the charging voltages by setting a margin on the basis of a temperature so that white points do not occur.

On the other hand, in the case of the charging rolls CRy-CRk whose surfaces are formed with asperities, a study of the inventors has shown that white points disappear with a smaller margin than in the case of conventional charging rolls whose surfaces are low in the degree of asperity. As a result, if charging voltages that are determined with a conventional margin are applied to the charging rolls CRy-CRk whose surfaces are formed with asperities, the charging voltages are excessive and hence accelerate the deterioration of the charging rolls CRy-CRk (i.e., shorten their lives). However, a study of the inventors has also shown the following. Consider a case that in view of the above the margin is decreased with the conventional control. Even if a margin is set in such a manner as not to cause white points, color points come to occur as the temperature increases, more remarkably as the humidity also increases. Although no detailed mechanism is known, it appears that this phenomenon is considered due to the fact that the asperities decrease the contact areas between the charging rolls CRy-CRk and the photoreceptor bodies Py-Pk. In short, if the conventional control which is directed to charging rolls whose surfaces are low in the degree of asperity is employed as it is, image defects may occur.

In contrast, in the first exemplary embodiment of the invention, the margin Ma is switched at the temperature threshold value Ta between the temperature margin Mt and the humidity margin Mh. Therefore, in a low-temperature environment, a constant current value $I_{ac}$ is set so as not to cause white points and no color points occur with this constant current value $I_{ac}$. On the other hand, in a high-temperature environment (the ambient temperature Te is higher than or equal to the threshold value Ta), a constant current value $I_{ac}$ is set so as not to cause color points and white points are prevented automatically with this constant current value $I_{ac}$. As a result, occurrence of image defects is suppressed even with the charging rolls CRy-CRk whose surfaces are formed with asperities because the margin Ma is switched between the temperature margin Mt and the humidity margin Mh.

EXPERIMENTS 1 and 2

Next, a description will be made of Experiment 1 and Experiment 2 that are conducted to confirm the effects of the first exemplary embodiment.

Experiment 1 and Experiment 2 are conducted by using a printer DCC450 of Fuji Xerox Co., Ltd. Therefore, the charging roll CRk is a member of about 12 mm in diameter in which the surface of a metal conductor shaft 1 is coated with an elastic layer (elastic rubber layer) dispersed with a conductive material such as carbon black and a 9-μm-thick nylon resin layer dispersed with nylon fine particles of several micrometers in diameter is formed on the surface of the elastic layer. The photoreceptor Pk is a photoreceptor drum which in about 30 mm in diameter, uses an organic photoreceptor, and has a charge transport layer of 34 μmin thickness. In Experiment 1 and Experiment 2, a charging voltage in which an AC voltage having a reference current value $I_k$ of 1.5 mA and $V_{pp}$ of 1.7 kV is superimposed on a DC voltage of −700 V is applied to the charging roll CRk. Therefore, the charging surface potential of the surface of the photoreceptor Pk is about −700 V.

In Experiment 1, a lower limit margin Ma capable of preventing white points is measured for each temperature environment. In Experiment 2, a lower limit margin Ma capable of preventing color points is measured for each temperature environment with the humidity fixed.

Lower limit margins Ma are measured at ambient temperatures of 10° C., 15° C., 20° C., 25° C., 30° C., 35° C., and 40° C.

EXPERIMENT 1-1

In Experiment 1-1, lower limit margins Ma capable of preventing white points are determined using the charging roll CRk according to the first exemplary embodiment whose surface is formed with minute asperities.

COMPARATIVE EXPERIMENT 1-1

In Comparative Experiment 1-1, lower limit margins Ma capable of preventing white points are determined using a conventional charging roll whose surface is formed with minute asperities only at low density.

EXPERIMENT 2-1

In Experiment 2-1, lower limit margins Ma capable of preventing color points and black points are determined using the same charging roll CRk as used in Experiment 1-1 in a state that the ambient humidity is 20% RH.

EXPERIMENT 2-2

In Experiment 2-2, lower limit margins Ma capable of preventing color points and black points are determined using the same charging roll CRk as used in Experiment 1-1 in a state that the ambient humidity is 50% RH.

EXPERIMENT 2-3

In Experiment 2-3, lower limit margins Ma capable of preventing color points and black points are determined using the same charging roll CRk as used in Experiment 1-1 in a state that the ambient humidity is 80% RH.

Figure 7:
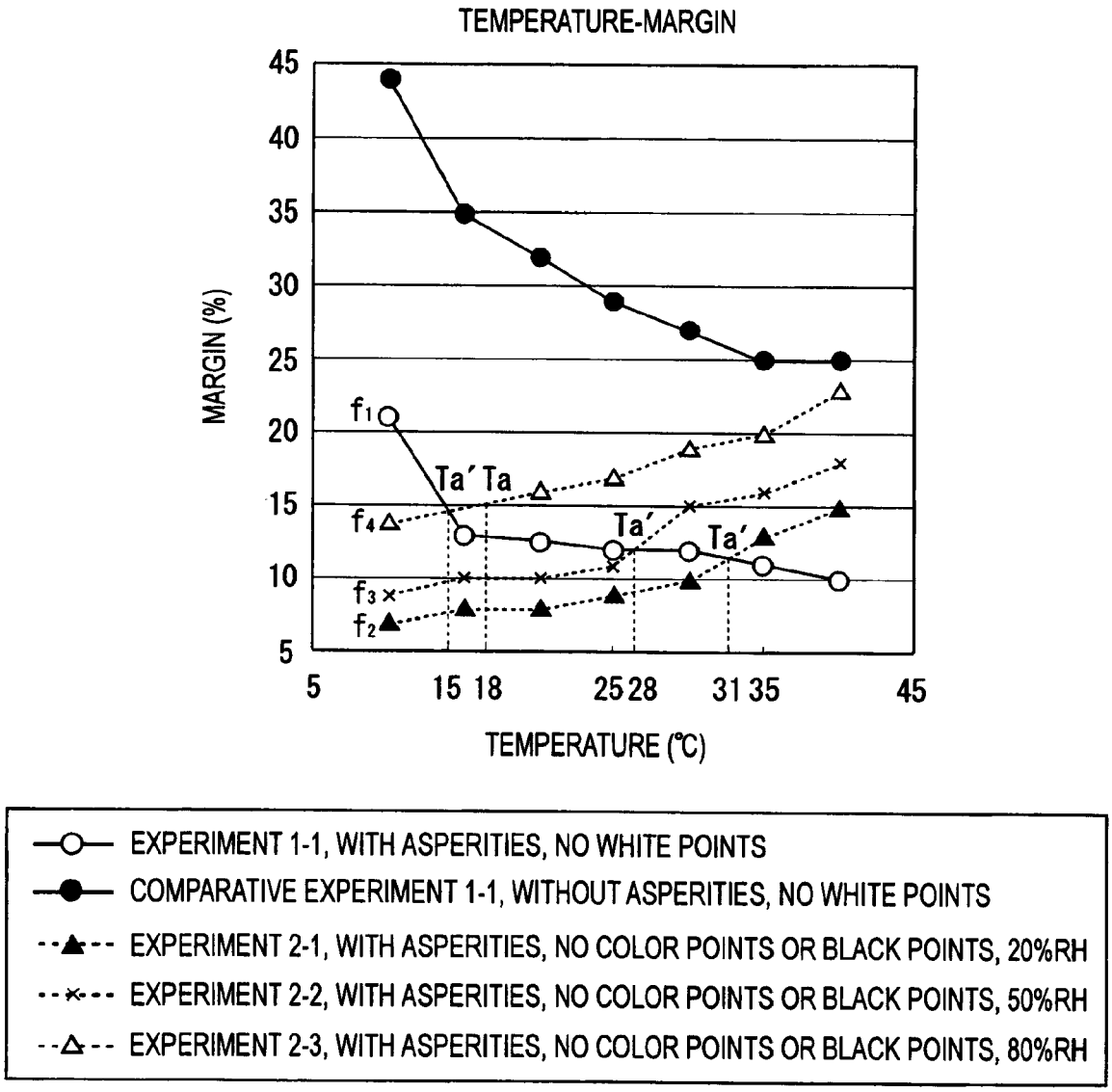
FIG. 7 is a graph showing results of Experiment 1 and Experiment 2 in which the horizontal axis represents the ambient temperature and the vertical axis represents the margin which is an example correction value.

FIG. 7 is a graph showing results of Experiment 1 and Experiment 2 in which the horizontal axis represents the ambient temperature and the vertical axis represents the margin which is an example correction value.

As seen from FIG. 7, when the ambient temperature is in the range of 10° C. to 40° C., the lower limit margin capable of preventing white points in Experiment 1-1 is lower than that in Comparative Experiment 1-1. It has thus been confirmed that in the case of the charging roll CRk whose surface is formed with minute asperities white points disappear with a smaller margin than in the case of the conventional charging roll which is low in the degree of asperity.

It is also seen that the lower limit margin capable of preventing color points and black points decreases in order of Experiment 2-3→Experiment 2-2→Experiment 2-1. It has thus been confirmed that in the case of the charging roll CRk whose surface is formed with minute asperities color points and black points become less likely to occur as the ambient humidity Hu decreases.

Comparison between the lower limit margin capable of preventing white points in Experiment 1-1 and the lower limit margins capable of preventing color points and black points in Experiments 2-1, 2-2, and 2-3 shows that the lower limit margin capable of preventing white points in Experiment 1-1 is larger than the lower limit margins capable of preventing color points and black points in Experiments 2-1, 2-2, and 2-3 when the ambient temperature Te is low. The lower limit margin capable of preventing white points in Experiment 1-1 becomes equal to the lower limit margins capable of preventing color points and black points in Experiments 2-1, 2-2, and 2-3 at 31° C., 28° C., and 15° C., respectively; it has thus been confirmed that the temperature at which the two kinds of lower limit margins become identical increases as the ambient humidity Hu decreases. It has also been confirmed that in the temperature ranges higher than those ambient temperatures the lower limit margin capable of preventing white points is lower than the lower limit margin capable of preventing color points and black points.

It is therefore understood that both of white points and color points etc. can be prevented by using a margin capable of preventing white points when the ambient temperature Te is lower than the threshold ambient temperature at which the lower limit margin capable of preventing white points is the same as the lower limit margin capable of preventing color points and black points and using a margin capable of preventing color points and black points when the ambient temperature Te is higher than or equal to the threshold ambient temperature. More specifically, for example, when the ambient humidity is 80% RH, a satisfactory result can be obtained by using a margin capable of preventing white points when the ambient temperature Te is lower than 15° C. and using a margin capable of preventing color points etc. when the ambient temperature Te is higher than or equal to 15° C. It has thus been confirmed that in the configuration in which the charging voltage is applied in such a manner that the margin is switched at the threshold ambient temperature white points, color points, etc. can be prevented and the probability of occurrence of image defects can be lowered even with the charging roll CRk whose surface is formed with asperities, unlike in the configuration in which the charging voltage is applied by the conventional margin determining method.

In the first exemplary embodiment, the temperature threshold value Ta at which switching is made between the temperature margin Mt and the humidity margin Mh is set at 18° C. This will be explained below in more detail. The lower limit margin capable of preventing white points in Experiment 1-1 varies only in a small degree in the ambient temperature range that is equal to or higher than 16° C. The temperature threshold value Ta is set at 18° C. for every ambient humidity value Hu, and in the temperature range that is lower than 18° C. a margin is set so as to conform to the results of Experiment 1-1 and Experiment 2-3. In the temperature range that is higher than or equal to 18° C., for each humidity value a margin is set so as to conform to a difference of the margin of Experiment 2-1, 2-2, or 2-3 from that of Experiment 1-1.

As such, in the first exemplary embodiment, with the single temperature threshold value, white points, color points, etc. are prevented and the probability of occurrence of image defects is lowered in every temperature/humidity environment.

[Second Exemplary Embodiment]

Next, a second exemplary embodiment of the invention will be described. In the description of the second exemplary embodiment, components having corresponding ones in the first exemplary embodiment will be given the same reference symbols as the latter and will not be described in detail.

The second exemplary embodiment is the same as the first exemplary embodiment except the following points.

(Control Section C' of Second Exemplary Embodiment)

Figure 8:
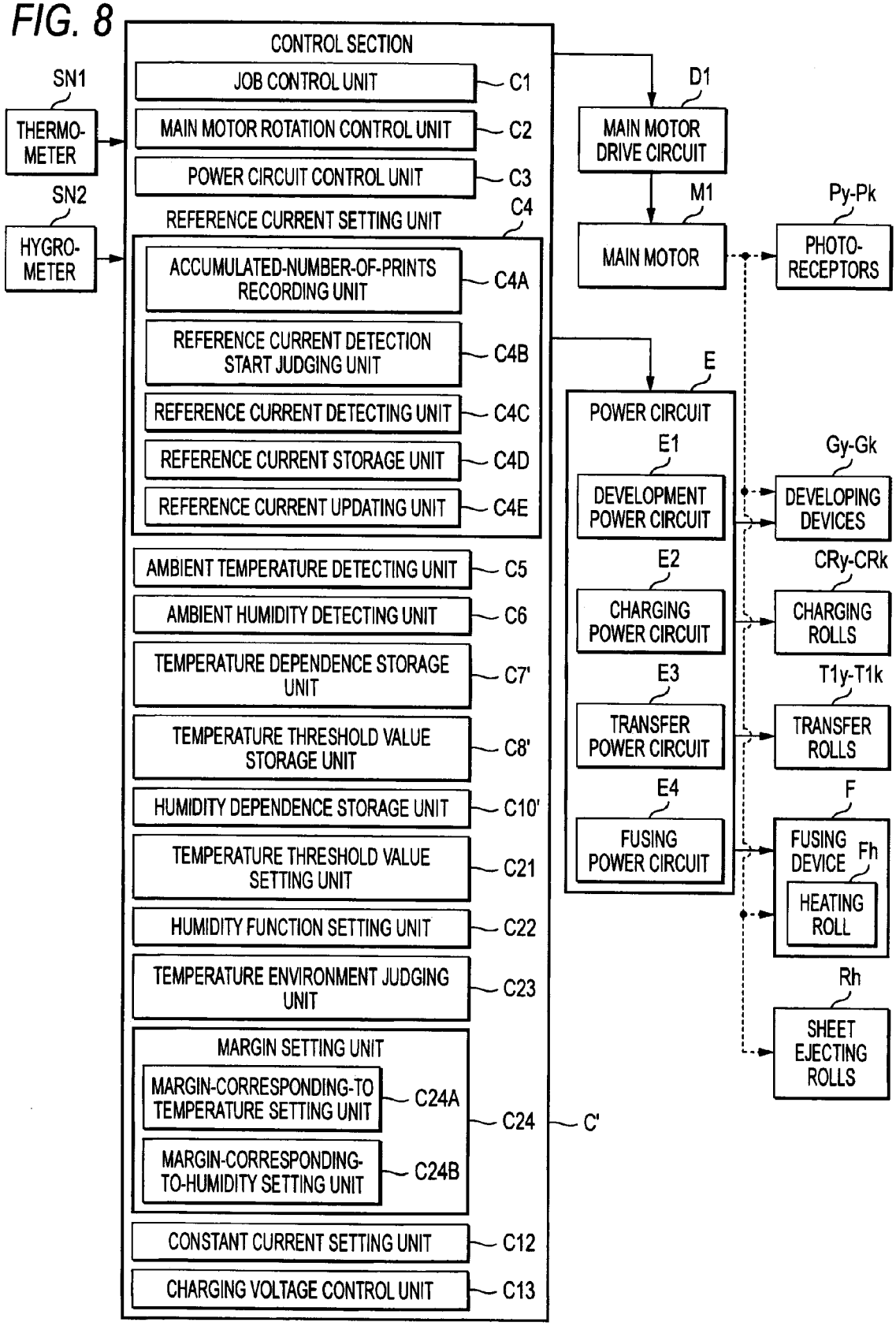
FIG. 8 is a block diagram showing functions of a control section of an image forming apparatus according to a second exemplary embodiment of the invention and corresponds to FIG. 3 (first exemplary embodiment)

FIG. 8 is a block diagram showing functions of a control section C' of an image forming apparatus according to a second exemplary embodiment of the invention and corresponds to FIG. 3 (first exemplary embodiment).

The control section C' is equipped with a temperature dependence storage unit C7', a temperature threshold value storage unit C8', a humidity dependence storage unit C10', a temperature threshold value setting unit C21, a humidity function setting unit C22, a temperature environment judging unit C23, and a margin setting unit C24 in place of the temperature dependence storage unit C7, the temperature threshold value storage unit C8, the temperature environment judging unit C9, the humidity dependence storage unit C10, and the margin setting unit C11 according to the first exemplary embodiment.

The other components of the control section C' are the same as in the first exemplary embodiment and hence will not be described in detail.

(Functions of Control Section C')

Temperature dependence storage unit C7': Unlike the temperature dependence storage unit C7 according to the first exemplary embodiment which stores the temperature-dependent correction table TA1, the temperature dependence storage unit C7' according to the second exemplary embodiment stores, as example temperature dependence, a temperature function $f_1$ (T) which represents a relationship between the temperature T and the margin at which white points disappear (see FIG. 7).

Temperature threshold value storage unit C8': The temperature threshold value storage unit C8' stores preset temperature threshold values Ta' corresponding to ambient humidity ranges. The temperature threshold value storage unit C8' according to the second exemplary embodiment stores, as the temperature threshold values Ta', 31° C. for the ambient humidity range that is lower than 20% RH, 28° C. for the ambient humidity range that is higher than or equal to 20% RH and lower than 50% RH, and 15° C. for the ambient humidity range that is higher than or equal to 50% RH and lower than 80% RH and the ambient humidity range that is higher than or equal to 80% RH. That is, the temperatures at which the lower limit margin capable of preventing white points is the same as the lower limit margin capable of preventing color points and black points for the respective humidity values Hu are stored according to the experimental results shown in FIG. 7. The specific values of the temperature threshold values Ta' are not limited to the above example values and can be changed arbitrarily according to the design, specification, etc.

Humidity dependence storage unit C10': Unlike the humidity dependence storage unit C10 according to the first exemplary embodiment which stores the humidity correction table TA2, the humidity dependence storage unit C10' stores, as example humidity dependence, humidity functions $f_2$ (T), $f_3$ (T), and $f_4$ (T) for the respective humidity values which represent relationships between the temperature and the margin at which color points disappear (see FIG. 7).

Temperature threshold value setting unit C21: The temperature threshold value setting unit C21 selects the temperature threshold value Ta' corresponding to ambient humidity Hu detected by the ambient humidity detecting unit C6 from the temperature threshold values stored in the temperature threshold value storage unit C8' and sets it.

Humidity function setting unit C22: The humidity function setting unit C22 sets the humidity function corresponding to the detected ambient humidity Hu. In the second exemplary embodiment, according to the experimental results shown in FIG. 7, the humidity function $f_2$ (T) for low humidity (the ambient humidity Hu is lower than 20% RH), the humidity function $f_3$ (T) for medium humidity (the ambient humidity Hu is higher than or equal to 20% RH and lower than 50% RH), and the humidity function $f_4$ (T) for high humidity (the ambient humidity Hu is higher than or equal to 50% RH and lower than 80% RH or higher than or equal to 80% RH) are stored in the humidity dependence storage unit C10' in advance as humidity functions corresponding to the respective ambient humidity ranges. The humidity function setting unit C22 according to the second exemplary embodiment selects the humidity function corresponding to the detected humidity Hu from $f_2$ (T)-$f_4$ (T) and sets it.

Temperature environment judging unit C23: The temperature environment judging unit C23 judges, on the basis of the ambient temperature Te detected by the ambient temperature detecting unit C5, whether the temperature environment is such that the temperature is higher than or equal to the temperature threshold value Ta' set by the temperature threshold value setting unit C21.

Margin setting unit C24: The margin setting unit C24 as an example correction value setting unit, which has a margin-corresponding-to-temperature setting unit C24A and a margin-corresponding-to-humidity setting unit C24B, sets a margin Ma' which is an example correction value to be used for correcting a reference current value $I_k$ which is to be used for determining a constant current value $I_{ac}$.

Margin-corresponding-to-temperature setting unit C24A: The margin-corresponding-to-temperature setting unit C24A which is an example correction-value-corresponding-to-temperature setting unit sets a margin Ma' corresponding to the ambient temperature Te on the basis of the temperature function $f_1$ (T) and the ambient temperature Te. The margin-corresponding-to-temperature setting unit C24A according to the second exemplary embodiment calculates, on the basis of the ambient temperature Te, a value $f_1$ (Te) of the temperature function $f_1$ (T) which is stored in advance on the basis of the experimental results shown in FIG. 7 and sets it as a margin Ma' when the ambient temperature Te is lower than the temperature threshold value Ta'.

Margin-corresponding-to-humidity setting unit C24B: The margin-corresponding-to-humidity setting unit C24A which is an example correction-value-corresponding-to-humidity setting unit sets a margin Ma' corresponding to the ambient temperature Te on the basis of a humidity function and the ambient temperature Te. The margin-corresponding-to-humidity setting unit C24B according to the second exemplary embodiment calculates, on the basis of the ambient temperature Te, a value of one of the humidity functions $f_1$ (T)-$f_4$ (T) that has been set by the humidity function setting unit C22 and sets it as a margin Ma' when the ambient temperature Te is higher than or equal to the temperature threshold value Ta'.

(Flowchart of Second Exemplary Embodiment)

Next, a process executed in the printer U' according to the second exemplary embodiment of the invention will be described with reference to a flowchart.

(Flowchart of Charging Voltage Control Process of Second Exemplary Embodiment)

Figure 9:
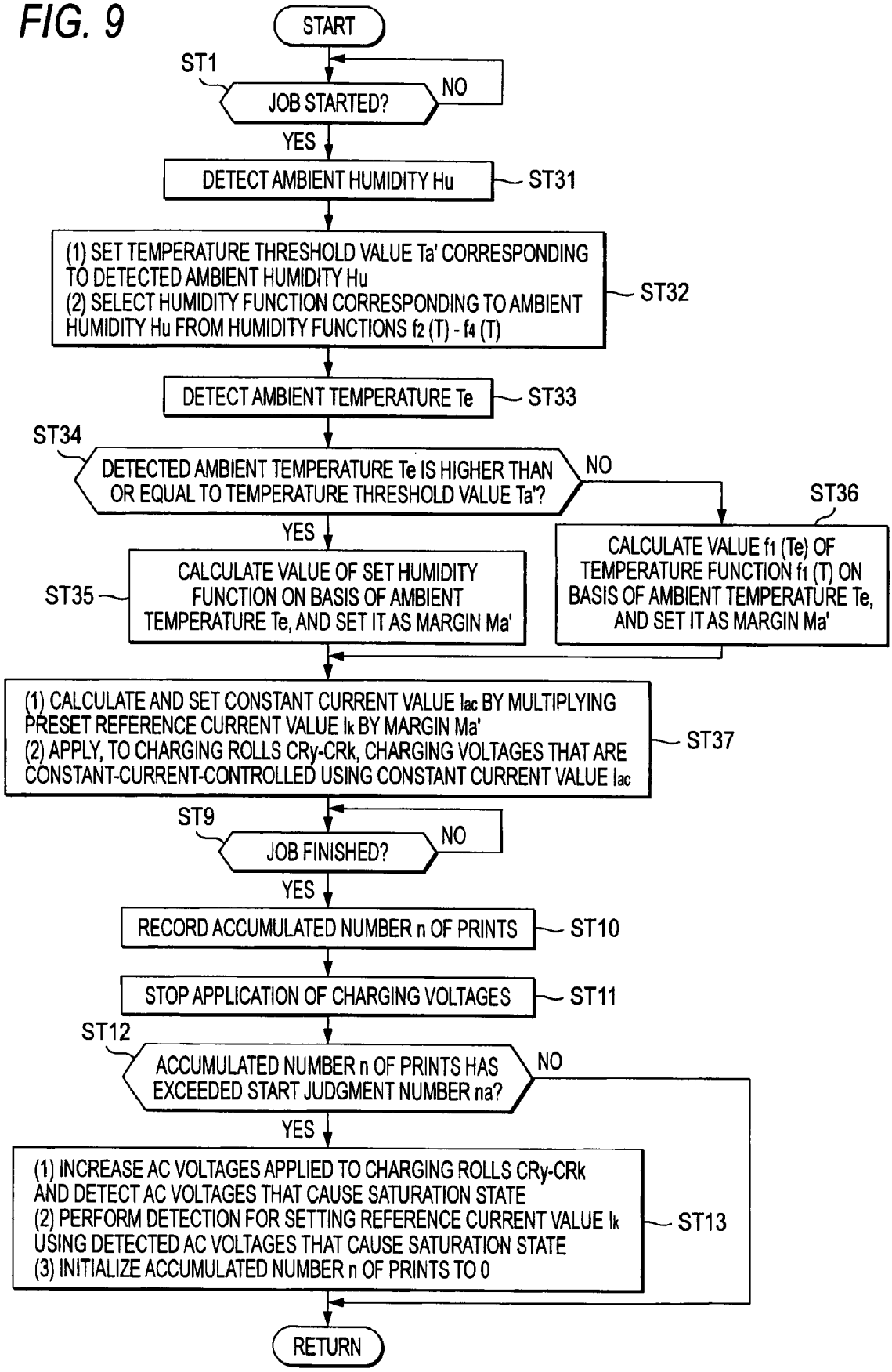
FIG. 9 is a flowchart of a charging voltage control process which is executed in the image forming apparatus according to the second exemplary embodiment of the invention and corresponds to FIG. 6 (first exemplary embodiment)

FIG. 9 is a flowchart of a charging voltage control process which is executed in the printer U' according to the second exemplary embodiment and corresponds to FIG. 6 (first exemplary embodiment).

(Flowchart of Charging Voltage Control Process of Second Exemplary Embodiment)

The charging voltage control process of the printer U' according to the second exemplary embodiment is different from that of the printer U according to the first exemplary embodiment in that steps ST31-ST37 of the former replace steps ST2-ST8 of the latter. The other steps ST1 and ST9-ST13 are the same as in the first exemplary embodiment and hence will not be described in detail.

At step ST31 shown in FIG. 9, ambient humidity Hu is detected, then the process moves to step ST32. At step ST32, the following pieces of processing (1) and (2) are performed (the process thereafter moves to step ST33):

(1) Set a temperature threshold value Ta' corresponding to the detected ambient humidity Hu.

(2) Select a humidity function corresponding to the detected ambient humidity Hu from the humidity functions $f_2$ (T)-$f_4$ (T) and set it.

At step S33, an ambient temperature Te is detected, then the process moves to step ST34.

At step S34, it is judged whether the detected ambient temperature Te is higher than or equal to the set temperature threshold value Ta'. The process moves to step ST35 if the judgment result is affirmative, and moves to step ST36 if the judgment result is negative.

At step ST35, a value of the set humidity function is calculated on the basis of the ambient temperature Te and is set as a margin Ma'. Then, the process moves to step ST37.

At step ST36, a value $f_1$ (Te) of the temperature function $f_1$ (T) is calculated on the basis of the ambient temperature Te and is set as a margin Ma'. Then, the process moves to step ST37.

At step S37, the following pieces of processing (1) and (2) are performed (the process thereafter moves to step ST9):

(1) Calculate and set a constant current value $I_{ac}$ by multiplying a preset reference current value $I_k$ by the margin Ma'.

(2) Apply, to the charging rolls CRy-CRk, charging voltages that are constant-current-controlled using the constant current value $I_{ac}$.

(Operation of Second Exemplary Embodiment)

In the above-configured printer U' according to the second exemplary embodiment of the invention, while a job is carried out, a temperature threshold value Ta' is set on the basis of detected ambient humidity Hu and a humidity function corresponding to the ambient humidity Hu is selected from the humidity functions $f_2$ (T)-$f_4$ (T).

If ambient temperature Te detected by the thermometer SN1 is higher than or equal to the set temperature threshold value Ta', a value of the set humidity function is calculated and set as a margin Ma'. A constant current value $I_{ac}$ is determined and set by multiplying a reference current value $I_k$ by the margin Ma'.

If the ambient temperature Te detected by the thermometer SN1 is lower than the set temperature threshold value Ta', a value $f_1$ (Te) of the temperature function $f_1$ (T) is set as a margin Ma'. A constant current value $I_{ac}$ is determined and set by multiplying the reference current value $I_k$ by the margin Ma'.

As described above, a margin Ma' is set by switching, according to ambient temperature Te and a temperature threshold value Ta' corresponding to ambient humidity Hu, between the temperature function $f_1$ (T) and one of the humidity functions $f_2$ (T)-$f_4$ (T) that is selected according to the ambient humidity Hu.

In the second exemplary embodiment of the invention, since the three temperature threshold values for setting of a margin Ma' are employed which corresponding to respective ambient humidity ranges, switching is performed finely between the temperature function $f_1$ (T) and the humidity functions $f_2$ (T)-$f_4$ (T) unlike in the first exemplary embodiment which employs the single temperature threshold value Ta. As a result, white points, color points, etc. are prevented more correctly according to ambient temperature Te and ambient humidity Hu than in the first exemplary embodiment. Furthermore, since charging voltages are applied with a smaller constant current value $I_{ac}$, deterioration of the charging rolls CRy-CRk due to excessive charging voltages is suppressed and the life of the printer U' is prevented from being shortened.

[Third Exemplary Embodiment]

Next, a third exemplary embodiment of the invention will be described. In the description of the third exemplary embodiment, components having corresponding ones in the first or second exemplary embodiment will be given the same reference symbols as the latter and will not be described in detail.

The third exemplary embodiment is the same as the first or second exemplary embodiment except the following points.

(Control Section C" of Third Exemplary Embodiment)

Figure 10:
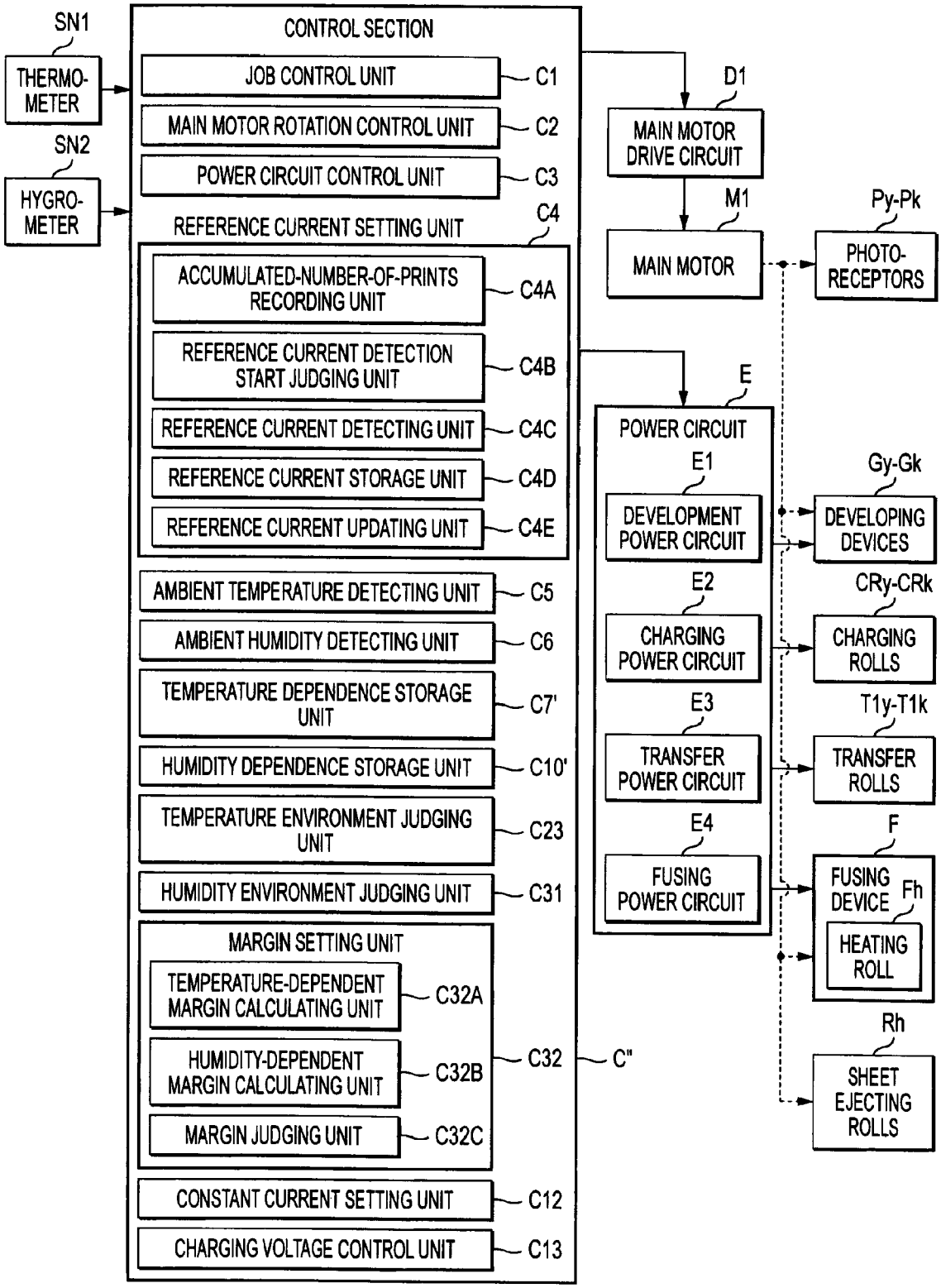
FIG. 10 is a block diagram showing functions of a control section of an image forming apparatus according to a third exemplary embodiment of the invention and corresponds to FIG. 8 (second exemplary embodiment)

FIG. 10 is a block diagram showing functions of a control section C" of an image forming apparatus according to a third exemplary embodiment of the invention and corresponds to FIG. 8 (second exemplary embodiment).

The control section C" has a humidity environment judging unit C31 and a margin setting unit C32 in place of the temperature threshold value storage unit C8', the temperature threshold value setting unit C21, the humidity function setting unit C22, and the margin setting unit C24.

The other components of the control section C" are the same as in the first or second exemplary embodiment and hence will not be described in detail.

(Functions of Control Section C")

Humidity environment judging unit C31: The humidity environment judging unit C31 judges a humidity environment of the printer U" on the basis of ambient humidity Hu detected by the ambient humidity detecting unit C6. The humidity environment judging unit C31 according to the third exemplary embodiment judges a humidity environment by judging whether the ambient humidity Hu falls into a low-humidity environment (Hu<20% RH), a medium-humidity environment (20% RH≦Hu<50% RH), or a high-humidity environment (50% RH≦Hu).

Margin setting unit C32: The margin setting unit C32, which has a temperature-dependent margin calculating unit C32A, a humidity-dependent margin calculating unit C32B, and a margin judging unit C32C, sets a margin Ma" which is an example correction value to be used for correcting a reference current value $I_k$ which is to be used for determining a constant current value $I_{ac}$.

Temperature-dependent margin calculating unit C32A: The temperature-dependent margin calculating unit C32A calculates a temperature-dependent margin Mt" on the basis of the temperature function $f_1$ (T) stored in the temperature dependence storage unit C7' and ambient temperature Te. The temperature-dependent margin calculating unit C32A according to the third exemplary embodiment calculates a temperature-dependent margin Mt" by substituting the ambient temperature Te into the temperature function $f_1$ (T).

Humidity-dependent margin calculating unit C32B: The humidity-dependent margin calculating unit C32B calculates a humidity-dependent margin Mh" on the basis of the ambient temperature Te and a humidity function corresponding to the ambient humidity Hu among the humidity functions $f_2$ (T)-$f_4$ (T) stored in the humidity dependence storage unit C10'. For example, the humidity-dependent margin calculating unit C32B according to the third exemplary embodiment calculates a humidity-dependent margin Mh" by substituting the ambient temperature Te into the humidity function $f_2$ (T) if the ambient humidity Hu falls into the low-humidity environment.

Margin judging unit C32C: The margin judging unit C32C employs one of the calculated margins Mt" and Mh" as a margin Ma". The margin judging unit C32C according to the third exemplary embodiment employs a larger one of the margins Mt" and Mh" as a margin Ma". The margin setting unit C32 sets, as a margin Ma" to be used for correcting a reference current value $I_k$, the margin Ma" determined by the margin judging unit C32C.

(Flowchart of Third Exemplary Embodiment)

Figure 11:
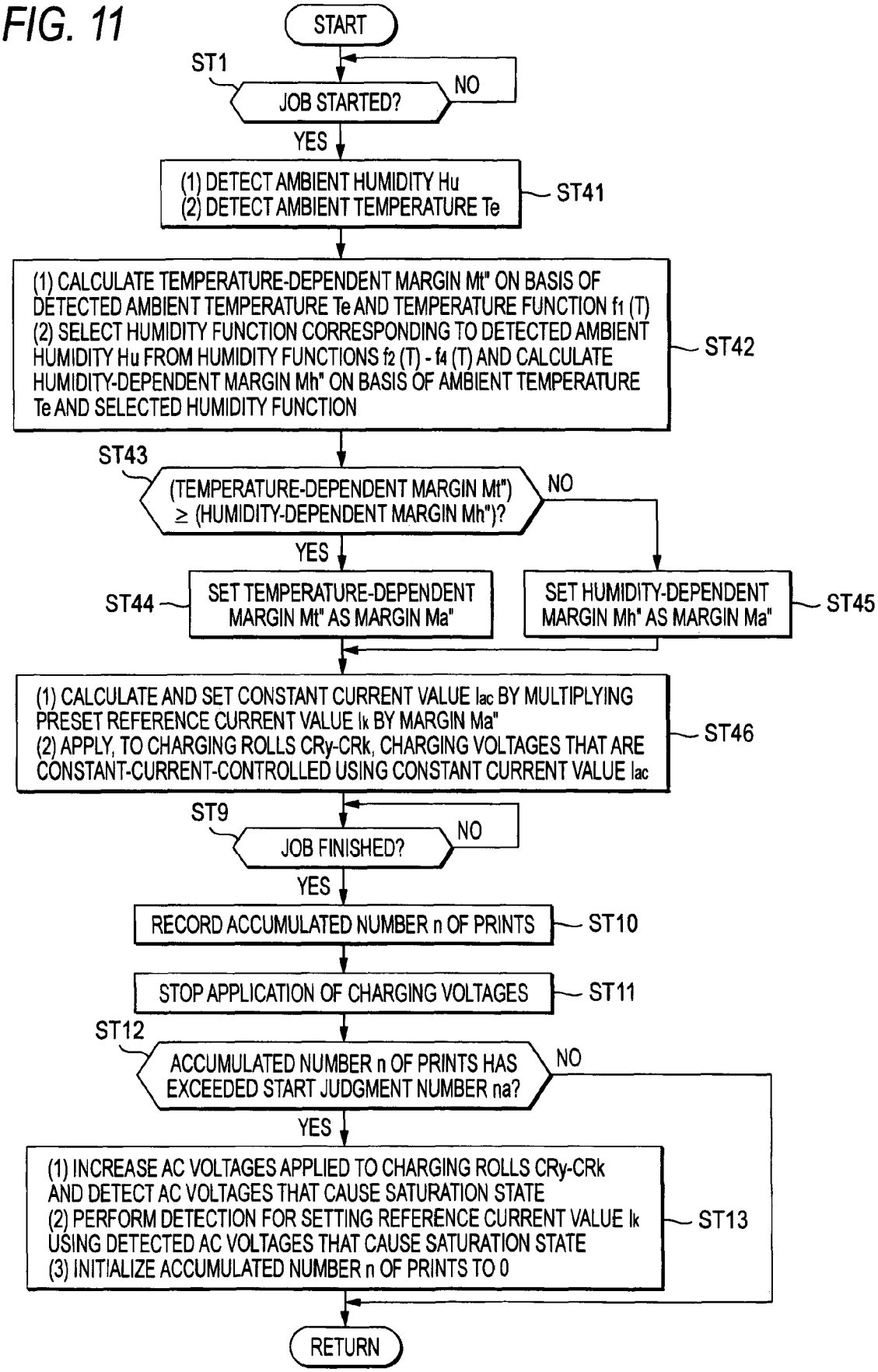
FIG. 11 is a flowchart of a charging voltage control process which is executed in the image forming apparatus according to the third exemplary embodiment of the invention and corresponds to FIG. 9 (second exemplary embodiment).

FIG. 11 is a flowchart of a charging voltage control process which is executed in the printer U" according to the third exemplary embodiment and corresponds to FIG. 9 (second exemplary embodiment).

(Flowchart of Charging Voltage Control Process of Third Exemplary Embodiment)

The charging voltage control process of the image forming apparatus according to the third exemplary embodiment is different from that of the printer U' according to the second exemplary embodiment in that steps ST41-ST46 of the former replace steps ST31-ST37 of the latter. The other steps ST1 and ST9-ST13 are the same as in the first exemplary embodiment and hence will not be described in detail.

At step ST41 shown in FIG. 11, the following pieces of processing (1) and (2) are performed (the process thereafter moves to step S42):

(1) Detect ambient humidity Hu.

(2) Detect an ambient temperature Te.

The following pieces of processing (1) and (2) are performed at step ST42 (the process thereafter moves to step S43):

(1) Calculate temperature-dependent margin Ma" on the basis of the detected environment temperature Te and the temperature function $f_1$ (T).

(2) Select a humidity function corresponding to the detected ambient humidity Hu from the humidity functions $f_2$ (T)-$f_4$ (T) and calculates a humidity-dependent margin Mh" by substituting the ambient temperature Te into the selected humidity function.

At step S43, it is judged whether the temperature-dependent margin Mt" is larger than or equal to the humidity-dependent margin Mh". The process moves to step ST44 if the judgment result is affirmative, and moves to step ST45 if the judgment result is negative.

At step ST44, the temperature-dependent margin Mt" is set as a margin Ma". Then, the process moves to step ST46.

At step ST45, the humidity-dependent margin Mh" is set as a margin Ma". Then, the process moves to step ST46.

At step ST46, the following pieces of processing (1) and (2) are performed (the process thereafter moves to step S9):

(1) Calculate and set a constant current value $I_{ac}$ by multiplying a preset reference current value $I_k$ by the margin Ma".

(2) Apply, to the charging rolls CRy-CRk, charging voltages that are constant-current-controlled using the constant current value $I_{ac}$.

(Operation of Third Exemplary Embodiment)

In the above-configured printer U" according to the third exemplary embodiment, a larger one of a temperature-dependent margin Mt" calculated from the temperature function $f_1$ (T) and a humidity-dependent margin Mh" calculated from one of the humidity functions $f_2$ (T)-$f_4$ (T) is employed as a margin Ma". Therefore, in the third exemplary embodiment, unlike in the first and second exemplary embodiments, a margin Ma" capable of preventing both of white points and color points (see FIG. 7) is set without using any threshold value.

(Modifications)

Although the embodiments of the invention have been described above, the invention is not limited to those embodiments and various modifications are possible without departing from the spirit and scope of the invention as described in the claims. Modifications (H01)-(H06) according to the invention will be described below:

(H01) Although the embodiments are directed to the printers U, U', and U" as example image forming apparatus, the invention is not limited to such a case. The invention can be applied to a facsimile machine, a copier, etc. or a multifunction machine having functions of all or plural ones of them. The invention is not limited to color image forming apparatus and can be applied to monochrome image forming apparatus. Furthermore, the invention is not limited to what is called tandem image forming apparatus and can be applied to rotary image forming apparatus or the like.

(H02) Although in the embodiments detection and setting of a reference current value $I_k$ are performed when the accumulated number n of prints has exceeded the preset start judgment number na, the invention is not limited to such a case. A condition for starting detection and setting of a reference current value $I_k$ may be set by using an arbitrary parameter such as the number of rotations of the photoreceptor Py or the drive time.

(H03) Although in the second and third exemplary embodiments a humidity function corresponding to ambient humidity Hu is selected from the humidity functions $f_2$ (T)-$f_4$ (T), the invention is not limited to such a case. It is possible to add humidity functions and select a humidity function corresponding to ambient humidity Hu from humidity functions corresponding to finer ambient humidity ranges. Furthermore, the invention is not limited to the case of using a single temperature threshold value Ta (first exemplary embodiment) and the case of using three temperature threshold values Ta' (second exemplary embodiment). It is possible to add temperature threshold values and perform switching more finely between the temperature function $f_1$ (T) and the resulting humidity functions according to an ambient temperature Te.

(H04) Although it is desirable that in the embodiments a charger cleaner as an example charger cleaning member be disposed so as to be in contact with each of the charging rolls CRy-CRk, it may be omitted.

(H05) The specific numerical values, materials, etc. used in the embodiments may be changed as appropriate according to the design, specification, etc.

(H06) Although in the embodiments a constant current value $I_{ac}$ is calculated by multiplying a reference current value by a margin Ma, Ma', or Ma", the invention is not limited to such a case. For example, where a reference current value is fixed, a function or a table representing a relationship between the constant current value and the temperature/humidity may be set without using a margin. In this case, a constant current value can be determined directly instead of calculating a constant current value indirectly using a margin.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A charging device, comprising:

a charging member disposed to be opposed to a body to be charged, the charging member including:

a conductor shaft;

a charging member main body that coats an outer circumferential surface of the conductor shaft; and a surface layer that coats a surface of the charging member main body and contains dispersed fine particles, the surface layer having a surface with asperities due to the dispersed fine particles;

a charging power source that applies a charging voltage to the charging member, the charging voltage being produced by superimposing a constant-current-controlled AC voltage on a preset DC voltage;

a temperature dependence storage unit that stores preset temperature dependence representing a relationship between a constant current value at the time the AC voltage is constant-current-controlled and an ambient temperature which is a temperature in a vicinity of the charging member;

a humidity dependence storage unit that stores preset humidity dependence representing a relationship between the constant current value and the ambient temperature and an ambient humidity which is a humidity in the vicinity of the charging member;

an ambient temperature detecting unit that detects an ambient temperature in the vicinity of the charging member;

an ambient humidity detecting unit that detects an ambient humidity in the vicinity of the charging member; and a charging voltage control unit that applies the charging voltage to the charging member according to a selection from one of (i) a constant current value that is determined according to the temperature dependence as corresponding to the detected ambient temperature and (ii) a constant current value that is determined according to the humidity dependence as corresponding to the detected ambient temperature and the detected ambient humidity.

2. The charging device according to claim 1, further comprising:

a temperature environment judging unit that judges whether or not the ambient temperature detected by the ambient temperature detecting unit is higher than or equal to a preset temperature threshold value, wherein the charging voltage control unit applies the charging voltage to the charging member through the charging power source using (i) the constant current value corresponding to the detected ambient temperature according to the temperature dependence when the detected ambient temperature is lower than the temperature threshold value, and the charging voltage control unit applies the charging voltage to the charging member through the charging power source using (ii) the constant current value corresponding to the detected ambient temperature and the detected ambient humidity according to the humidity dependence when the detected ambient temperature is higher than or equal to the temperature threshold value.

3. The charging device according to claim 2, further comprising:

a temperature threshold value storage unit that stores temperature threshold values that are preset according to respective ambient humidity ranges; and a temperature threshold value setting unit that sets a temperature threshold value corresponding to the ambient humidity detected by the ambient humidity detecting unit on the basis of the temperature threshold values stored in the temperature threshold value storage unit and the detected ambient humidity.

4. An image forming apparatus, comprising:

an image carrier as a body to be charged;

the charging device according to claim 1 disposed to be opposed to the image carrier, the charging device charging a surface of the image carrier;

a latent image forming device that forms a latent image on the charged surface of the image carrier;

a developing device that develops the latent image on the surface of the image carrier into a visible image;

a transfer device that transfers the visible image on the surface of the image carrier to a surface of a medium; and a fixing device that fixes the visible image on the surface of the medium.

5. The charging device according to claim 1, wherein the constant current value (i) or (ii) is calculated by multiplying a preset reference current value by a margin.

6. The charging device according to claim 5, further comprising:

an accumulated-number-of-prints recording unit that records an accumulated number n of prints.

7. The charging device according to claim 6, wherein whether or not the accumulated number n of prints exceeds a preset start judgment number na is judged, and when the accumulated number n of prints exceeds the preset start judgment number na, a saturation AC voltage that causes a saturation state of the charging member is detected by increasing the AC voltage applied to the charging member, the reference current value is set using the detected saturation AC voltage, and the accumulated number n of prints is initialized to 0.

* * * * *